US009355827B2

(12) United States Patent
Sugawara

(10) Patent No.: US 9,355,827 B2
(45) Date of Patent: May 31, 2016

(54) TRIPLE QUADRUPOLE MASS SPECTROMETER AND NON-TRANSITORY COMPUTER-READABLE MEDIUM RECORDING A PROGRAM FOR TRIPLE QUADRUPOLE MASS SPECTROMETER

(71) Applicant: SHIMADZU CORPORATION, Kyoto-shi, Kyoto (JP)

(72) Inventor: Hiroshi Sugawara, Kyoto (JP)

(73) Assignee: SHIMADZU CORPORATION, Kyoto (JP)

( * ) Notice: Subject to any disclaimer, the term of this patent is extended or adjusted under 35 U.S.C. 154(b) by 0 days.

(21) Appl. No.: 14/644,430

(22) Filed: Mar. 11, 2015

(65) Prior Publication Data

US 2015/0262800 A1 Sep. 17, 2015

(30) Foreign Application Priority Data

Mar. 12, 2014 (JP) ..... 2014-049043

(51) Int. Cl.

*H01J 49/26* (2006.01)
*H01J 49/42* (2006.01)
*H01J 49/00* (2006.01)

(52) U.S. Cl.

CPC ..... *H01J 49/0009* (2013.01); *H01J 49/005* (2013.01); *H01J 49/0031* (2013.01); *H01J 49/4215* (2013.01)

(58) Field of Classification Search

CPC ..... H01J 49/0009; H01J 49/26; H01J 49/004; H01J 49/0431; H01J 49/107; H01J 49/165; H01J 49/168; H01J 49/4215; H01J 49/0027; H01J 49/0031; H01J 49/0045; H01J 49/005; H01J 49/025; H01J 49/062; H01J 49/42; H01J 49/429

USPC ..... 250/282, 288, 281, 283, 287

See application file for complete search history.

(56) References Cited

U.S. PATENT DOCUMENTS

| | | | | |
|---|---|---|---|---|
| 7,365,317 | B2 * | 4/2008 | Whitehouse | H01J 49/42 250/287 |
| 8,269,166 | B2 * | 9/2012 | Okumura | H01J 49/0045 250/281 |
| 8,723,110 | B2 * | 5/2014 | Whitehouse | H01J 49/0431 250/282 |
| 8,748,811 | B2 * | 6/2014 | Okumura | H01J 49/0009 250/281 |
| 2011/0309243 | A1 * | 12/2011 | Whitehouse | H01J 49/0431 250/282 |
| 2015/0262800 | A1 * | 9/2015 | Sugawara | H01J 49/0009 250/252.1 |
| 2015/0279649 | A1 * | 10/2015 | Yamaguchi | H01J 49/0009 250/287 |

FOREIGN PATENT DOCUMENTS

| | | | |
|---|---|---|---|
| JP | 07-201304 | A | 8/1995 |
| JP | 11-183439 | A | 7/1999 |
| JP | 2011-249109 | A | 12/2011 |
| JP | 2012-043721 | A | 3/2012 |
| JP | 2012-159336 | A | 8/2012 |

* cited by examiner

*Primary Examiner* — David A Vanore
(74) *Attorney, Agent, or Firm* — Sughrue Mion, PLLC

(57) ABSTRACT

A triple quadrupole mass spectrometer provided with: a calibration information storage section for storing mass calibration information showing the relationship between the mass-to-charge ratio and a calibration value, with a CID gas pressure as a parameter, for each measurement mode of an MS/MS analysis including a dissociating operation using a collision cell; and a controller for calibrating the mass-to-charge ratio of the ion to be detected by a detector, by reading, from the calibration information storage section, the mass calibration information corresponding to the measurement mode to be performed and a specified CID gas pressure and by driving each the front and rear quadrupoles and using that information.

16 Claims, 5 Drawing Sheets

| MEASUREMENT MODE FOR MS ANALYSIS | Q1 | Q3 |
|---|---|---|
| FRONT-QUADRUPOLE SIM | SIM | — |
| FRONT-QUADRUPOLE SCAN | SCAN | — |
| REAR-QUADRUPOLE SIM | — | SIM |
| REAR-QUADRUPOLE SCAN | — | SCAN |

| MEASUREMENT MODE FOR MS/MS ANALYSIS | Q1 | Q3 |
|---|---|---|
| MRM | SIM | SIM |
| PRECURSOR-ION SCAN | SCAN | SIM |
| PRODUCT-ION SCAN | SIM | SCAN |
| NEUTRAL-LOSS SCAN | SCAN | SCAN |

Fig. 4

EXAMPLE OF TABLE IN MASS CALIBRATION TABLE SET FOR Q1 SCAN
(FOR CID GAS PRESSURE 200 kPa; ROWS: SCAN SPEED; COLUMNS: m/z)

| u/s \ m/z | 65.05 | 168.10 | 344.20 | 652.40 | 1004.60 | 1312.80 | 0.00 |
|---|---|---|---|---|---|---|---|
| 125 | −0.94 | −0.84 | −0.69 | −0.49 | +0.05 | +0.45 | +0.00 |
| 500 | −0.85 | −0.76 | −0.60 | −0.38 | +0.18 | +0.60 | +0.00 |
| 1000 | −0.75 | −0.54 | −0.47 | −0.23 | +0.36 | +0.80 | +0.00 |
| 1500 | −0.64 | −0.52 | −0.34 | −0.07 | +0.54 | +1.01 | +0.00 |
| 2000 | −0.54 | −0.41 | −0.21 | +0.07 | +0.72 | +1.21 | +0.00 |
| 2500 | −0.43 | −0.29 | −0.08 | +0.23 | +0.90 | +1.41 | +0.00 |
| 3000 | −0.35 | −0.20 | +0.04 | +0.39 | +1.11 | +1.66 | +0.00 |

EXAMPLE OF TABLE IN MASS CALIBRATION TABLE SET FOR Q3 SCAN
(FOR CID GAS PRESSURE 200 kPa; ROWS: SCAN SPEED; COLUMNS: m/z)

| u/s \ m/z | 65.05 | 168.10 | 344.20 | 652.40 | 1004.60 | 1312.80 | 0.00 |
|---|---|---|---|---|---|---|---|
| 125 | −0.94 | −0.84 | −0.64 | −0.24 | +0.25 | +0.75 | +0.00 |
| 500 | −0.91 | −0.81 | −0.61 | −0.21 | +0.29 | +0.79 | +0.00 |
| 1000 | −0.87 | −0.77 | −0.57 | −0.16 | +0.34 | +0.85 | +0.00 |
| 1500 | −0.83 | −0.73 | −0.52 | −0.11 | +0.39 | +0.90 | +0.00 |
| 2000 | −0.79 | −0.69 | −0.48 | −0.07 | +0.44 | +0.95 | +0.00 |
| 2500 | −0.76 | −0.65 | −0.44 | −0.02 | +0.49 | +1.01 | +0.00 |
| 3000 | −0.71 | −0.61 | −0.39 | +0.02 | +0.54 | +1.06 | +0.00 |

SCAN SPEED: 30u/s
CID GAS PRESSURE: 390 kPa

SCAN SPEED: 30u/s
CID GAS PRESSURE: 390 kPa

TRIPLE QUADRUPOLE MASS SPECTROMETER AND NON-TRANSITORY COMPUTER-READABLE MEDIUM RECORDING A PROGRAM FOR TRIPLE QUADRUPOLE MASS SPECTROMETER

TECHNICAL FIELD

The present invention relates to a triple quadrupole mass spectrometer and a non-transitory computer-readable medium recording a program for a triple quadrupole mass spectrometer.

BACKGROUND ART

In a quadrupole mass spectrometer, an amount of voltage corresponding to the mass-to-charge-ratio (m/z) of a target ion to be analyzed (this voltage is composed of a DC voltage and a radio-frequency voltage combined together) is applied to a quadrupole mass filter to selectively allow the target ion to pass through the quadruple mass filter and be detected by a detector. In many cases, when the system is controlled so as to selectively allow an ion having a target mass-to-charge ratio to pass through the quadruple mass filter, a discrepancy occurs between the target mass-to-charge ratio and the mass-to-charge ratio of the actually detected ion, due to mechanical errors in the quadrupole mass filter, variations in the characteristics of electric circuits, conditions of the use environment, and other factors. To correct this discrepancy in the mass-to-charge ratio, a mass calibration (i.e. calibration of the mass-to-charge ratio) is normally performed before the measurement.

In the mass calibration task, as described in Patent Literature 1, a measurement is initially performed using a standard sample containing a component whose theoretical value of the mass-to-charge ratio is previously known. The obtained measured value of the mass-to-charge ratio is compared with the theoretical value to determine the mass deviation at that mass-to-charge ratio, and this mass deviation is stored as a calibration value in a memory device. Later on, in the measurement of a target sample, a controller reads the calibration value corresponding to the target mass-to-charge ratio from the memory device and corrects the voltage applied to the quadrupole mass filter using the calibration value so that the mass deviation will be zero. Consequently, an ion having the target mass-to-charge ratio is selectively allowed to pass through the quadrupole mass filter, to eventually arrive at and be detected by the detector.

Meanwhile, a mass spectrometric technique called the MS/MS analysis is commonly used for the purpose of identifying substances having high molecular weights and analyzing their structures. There are various configurations of mass spectrometers for performing MS/MS analyses, among which the triple quadrupole mass spectrometer is popularly used due to its comparatively simple structure and inexpensiveness.

As disclosed in Patent Literature 2 and other documents, a triple quadrupole mass spectrometer normally has a front-stage quadrupole mass filter (which is hereinafter called the "front quadrupole") and a rear-stage quadrupole mass filter (which is hereinafter called the "rear quadrupole"), with a collision cell (collision chamber) provided in between for breaking ions into fragments by collision induced dissociation (CID). Inside this collision cell, an ion guide with four (or more) poles is provided to transport ions while focusing them.

When various ions produced from a sample are introduced into the front quadrupole, the front quadrupole selectively allows only an ion having a specific mass-to-charge ratio to pass through it as a precursor ion. Meanwhile, CID gas (e.g. argon gas) is introduced into the collision cell. The precursor ion introduced into this collision cell collides with the CID gas and undergoes dissociation to be broken into various product ions. The precursor ion and various product ions are focused by the effect of the radio-frequency electric field formed by the quadrupole ion guide. When the various product ions produced by the CID are introduced into the rear quadrupole, the rear quadrupole selectively allows only a product ion having a specific mass-to-charge ratio to pass through it. The product ion which has been allowed to pass through the rear quadrupole arrives at and is detected by the detector.

Such a triple quadrupole mass spectrometer is capable of performing MS/MS analyses in various modes, such as the multiple reaction monitoring (MRM) measurement, product-ion scan measurement, precursor-ion scan measurement, and neutral-loss scan measurement.

In the MRM measurement, the mass-to-charge ratio of the ion which is allowed to pass through is fixed in each of the front and rear quadrupoles to measure the intensity of a specific product ion derived from a specific precursor ion. In the product-ion scan measurement, while the mass-to-charge ratio of the ion which is allowed to pass through the front quadrupole is fixed at a certain value, the mass-to-charge ratio of the ion which is allowed to pass through the rear quadrupole is varied to scan a predetermined range of mass-to-charge ratios. By this operation, a mass spectrum of product ions derived from a specific precursor ion is obtained.

The precursor-ion scan measurement is the opposite of the product-ion scan measurement: While the mass-to-charge ratio of the ion which is allowed to pass through the rear quadrupole is fixed at a certain value, the mass-to-charge ratio of the ion which is allowed to pass through the front quadrupole is varied to scan a predetermined range of mass-to-charge ratios. By this operation, a mass spectrum of precursor ions which generate a specific product ion is obtained. In the neutral-loss scan measurement, a mass scan over a predetermined mass range is performed in each of the front and rear quadrupoles while constantly maintaining the difference between the mass-to-charge ratio of the ion passing through the front quadrupole and that of the ion passing through the rear quadruple (i.e. the neutral loss). By this operation, a mass spectrum of precursor ions/product ions having a specific neutral loss is obtained.

Naturally, the triple quadrupole mass spectrometer can also be used to perform a normal scan measurement or selected ion monitoring (SIM) measurement in which no CID is performed in the collision cell. In this case, the operation of selecting an ion according to its mass-to-charge ratio is not performed in one of the front and rear quadrupoles; all the ions are allowed to pass through that quadrupole.

Since the two (front and rear) quadrupole mass filters are thus provided, the triple quadrupole mass spectrometer requires the mass calibration to be performed independently for each of the front and rear quadrupoles in order to improve the capability of selecting the precursor or product ion. In the case of conventional triple quadrupole mass spectrometers, the mass calibration information for MS/MS analyses is normally prepared independently for each of the front and rear quadrupoles based on a measurement result obtained by an MS analysis performed at a certain low level of scan speed using a standard sample. However, a problem exists in that, if the mass calibration information obtained in this manner is used as a basis for the mass calibration, the discrepancy in the mass-to-charge ratio axis in the mass spectrum will increase with an increase in the scan speed in some measurement modes, such as the precursor-ion or neutral-loss scan measurement.

Similarly to the mass calibration, the adjustment of the mass-resolving power is also performed using a measurement result obtained by an MS measurement performed at a certain low level of scan speed using a standard sample. This has the problem that the mass-resolving power decreases (i.e. the peak width of a peak profile corresponding to a single component increases) with an increase in the scan speed in some measurement modes, such as the precursor-ion scan or neutral-loss scan, or even if the mass-resolving power does not decrease, the sensitivity significantly decreases due to the decrease in the amount of ions passing through.

In recent years, substances to be analyzed have been more and more complex, while currently there is a strong demand for improving the efficiency of the analyzing task as well as enhancing the quality of the analysis. For example, in a system having a liquid chromatograph (LC) coupled with a triple quadrupole mass spectrometer, a product-ion scan measurement triggered by an MRM measurement or normal scan measurement may be performed in order to obtain structural information in conjunction with the measurement of the molecular weights of various components contained in a sample. In such a case, it is necessary to increase the scan speed and repeat the scan measurement with a shorter cycle of time, in order to ensure an adequate number of data points per one peak or to perform the product-ion scan measurement for both positive and negative ions as well as under multiple conditions with different amounts of collision energy. To meet such needs, increasing the mass-scan speed is indispensable, which makes the aforementioned problems more noticeable, such as the discrepancy in the mass-to-charge ratio axis and the decrease in the mass-resolving power.

Therefore, in Patent Literature 3, the present inventor has proposed a triple quadrupole mass spectrometer having a calibrating function in which mass calibration information showing the relationship between the mass-to-charge ratio and the calibration value (or resolution-adjusting value) with the scan speed as the parameter is stored for each measurement mode of the MS analysis and MS/MS analysis, and the mass-to-charge ratio of the ion to be detected by the detector is calibrated by driving each of the front and rear quadrupoles using the mass calibration value (or resolution-adjusting value) corresponding to the measurement mode to be performed and the scan speed specified. With the triple quadrupole mass spectrometer described in Patent Literature 3, it is possible to reduce the discrepancy in the mass-to-charge ratio axis of the mass spectrum or the decrease in the mass-resolving power and obtain a mass spectrum with a high level of mass accuracy or high level of mass resolution even in the case of performing an MS/MS analysis including a high-speed scan.

CITATION LIST

Patent Literature

Patent Literature 1: JP 11-183439 A
Patent Literature 2: JP 7-201304 A
Patent Literature 3: JP 2012-159336 A
Patent Literature 4: JP 2012-043721 A

SUMMARY OF INVENTION

Technical Problem

The previously described triple quadrupole mass spectrometer having the mass-calibrating function with the scan speed as the parameter does not have any problem if it has a comparatively narrow range of CID gas pressures that can be set. However, in recent years, there has been the trend toward the increasing upper limit of the range of CID gas pressure that can be set in the triple quadrupole mass spectrometer in order to improve the CID efficiency (ion dissociation efficiency) in the collision cell. In such a mass spectrometer which allows the setting of a wide range of CID gas pressures, if a mass calibration value or resolution-adjusting value obtained under a certain CID gas pressure is used in a sample analysis performed at a CID gas pressure that is significantly different from the aforementioned CID gas pressure, the problem of the discrepancy in the mass-to-charge ratio axis or the deterioration of the peak shape due to a decrease in the resolving power occurs.

FIGS. 6A, 6B, 6C, and 6D show measurement examples of the specific peak-profile waveforms obtained by measurements using the conventional aforementioned triple quadrupole mass spectrometer. It should be noted that, for ease of observation of the discrepancy in the mass-to-charge ratio axis, those measurement examples show the results obtained by measurements performed in a front quadrupole scan measurement mode (which will be described later) with CID gas introduced into the collision cell. In any of those measurement examples, the previously described mass calibration and resolution adjustment with the scan speed as the parameter were performed using a mass calibration value and resolution-adjusting value obtained at a CID gas pressure of 190 kPa. In examples of FIGS. 6A and 6B, the CID gas pressure used in the measurement was set at 190 kPa, i.e. the same level as used in obtaining the mass calibration value and resolution-adjusting value. The gas pressure was increased to 300 kPa in example of FIG. 6C and further to 330 kPa in example of FIG. 6D. The scan speed of the front quadrupole in each measurement was 30 u/s in example of FIG. 6A and 300 u/s in examples of FIGS. 6B-6D. In the cases of FIGS. 6A and 6B in which the measurements were performed under the same CID gas pressure as used in obtaining the mass calibration value and resolution-adjusting value, each of the centroid peaks indicated by the vertical lines is approximately located at the center of the horizontal axis of the graph, which demonstrates that there is no discrepancy in the mass-to-charge ratio axis. By contrast, in the cases of FIGS. 6C and 6D in which the measurements were performed under the higher CID gas pressures than the level used in obtaining the mass calibration value and resolution-adjusting value, although the mass-scan speed is the same as in example of FIG. 6B, a discrepancy in the mass-to-charge ratio axis occurred; in particular, a considerable amount of discrepancy is present in example of FIG. 6D in which the CID gas pressure was higher. Furthermore, the peak shapes of FIGS. 6C and 6D are worse than those in FIGS. 6A and 6B, which demonstrates that the mass-resolving power is not appropriately adjusted.

The present invention has been developed in view of the previously described points. Its primary objective is to provide a triple quadrupole mass spectrometer capable of reducing the discrepancy in the mass-to-charge ratio axis of the mass spectrum even in the case of performing an analysis under various CID gas pressures. Another objective of the present invention is to provide a triple quadrupole mass spectrometer capable of reducing the decrease in the mass-resolving power even in the case of performing an analysis under various CID gas pressures.

Solution to Problem

The first aspect of the present invention aimed at solving the previously described problem is a triple quadrupole mass spectrometer having: an ion source for ionizing a sample; a front quadrupole for selecting, as a precursor ion, an ion having a specific mass-to-charge ratio from various ions produced by the ion source; a collision cell for causing dissociation of the precursor ion by making the precursor ion collide with collision induced dissociation gas; a rear quadrupole for selecting an ion having a specific mass-to-charge ratio from various product ions produced by the dissociation; and a detector for detecting the ion passing through the rear quadrupole, the triple quadrupole mass spectrometer including:

a) a calibration information storage section for storing mass calibration information showing the relationship between the mass-to-charge ratio and a calibration value, with the pressure of a collision induced dissociation gas as a parameter, for each measurement mode of an MS/MS analysis including a dissociating operation using the collision cell; and b) a controller for calibrating the mass-to-charge ratio of the ion to be detected by the detector, by reading, from the calibration information storage section, the mass calibration information corresponding to the measurement mode to be performed and a specified pressure of the collision induced dissociation gas and by driving each of the front quadrupole and the rear quadrupole using that information.

The second aspect of the present invention aimed at solving the previously described problem is a triple quadrupole mass spectrometer having: an ion source for ionizing a sample; a front quadrupole for selecting, as a precursor ion, an ion having a specific mass-to-charge ratio from various ions produced by the ion source; a collision cell for causing dissociation of the precursor ion; a rear quadrupole for selecting an ion having a specific mass-to-charge ratio from various product ions produced by the dissociation; and a detector for detecting the ion passing through the rear quadrupole, the triple quadrupole mass spectrometer including:

a) a calibration information storage section for storing mass calibration information showing the relationship between the mass-to-charge ratio and a calibration value with the pressure of a collision induced dissociation gas in the case of performing a mass scan of the front quadrupole as a parameter and mass calibration information showing the relationship between the mass-to-charge ratio and the calibration value with the pressure of a collision induced dissociation gas in the case of performing a mass scan of the rear quadrupole as a parameter in an MS/MS analysis including a dissociating operation using the collision cell; and b) a controller for calibrating the mass-to-charge ratio of the ion to be detected by the detector, by selecting, according to the measurement mode of the MS/MS analysis to be performed, a necessary combination from among the mass calibration information stored in the calibration information storage section, by reading the mass calibration information corresponding to a specified pressure of the collision induced dissociation gas and by driving each of the front quadrupole and the rear quadrupole using that information.

Typical examples of the measurement mode of the MS/MS analysis in the first and second aspects of the present invention are the MRM measurement, precursor-ion scan measurement, product-ion scan measurement and neutral-loss scan measurement.

A specific example of the mass calibration information showing the relationship between the mass-to-charge ratio and the calibration value with the pressure of the collision induced dissociation gas as a parameter is a two-dimensional table in which each array of cells arranged in either the row or column direction are the fields for setting calibration values which respectively correspond to different mass-to-charge ratios while each array of cells arranged in the other direction are the fields for setting calibration values which respectively correspond to different pressures of the collision induced dissociation gas.

In both of the triple quadruple mass spectrometers according to the first and second aspects of the present invention, mass calibration information to be used in an MS/MS analysis including the ion-dissociating operation using the collision cell is held in the calibration information storage section. The difference between the first and second aspects of the present invention exists in that the first aspect of the present invention has the mass calibration information for each of the aforementioned measurement modes of the MS/MS analysis, while the second aspect of the present invention has a set of mass calibration information for the front quadrupole and another set of mass calibration information for the rear quadrupole, the two sets being common to all the measurement modes of the MS/MS analysis.

For example, when performing a product-ion scan measurement or neutral-loss scan measurement (both of which require a mass scan in the rear quadrupole), the triple quadrupole mass spectrometer according to the first aspect of the present invention allows a different set of mass calibration information to be used in the mass calibration of the rear quadrupole according to the measurement mode used. On the other hand, the triple quadrupole mass spectrometer according to the second aspect of the present invention is advantageous in that it requires a smaller amount of mass calibration information to be held, although it does not allow different sets of mass calibration information to be used in the mass calibration of the rear quadrupole according to, for example, whether a product-ion scan measurement or neutral-loss scan measurement is performed.

In any of the first and second aspects of the present invention, the controller retrieves, from the calibration information storage section, mass calibration information corresponding to the measurement mode of the MS/MS analysis to be performed and the specified pressure of the collision induced dissociation gas, and drives the front and rear quadrupoles using that information.

The calibration information storage section in the present invention may preferably be configured so that it holds, as the aforementioned mass calibration information, mass calibration information showing the relationship between the mass-to-charge ratio and the calibration value with a mass-scan speed as a parameter in addition to the pressure of the collision induced dissociation gas.

According to this configuration, it is possible to perform a mass calibration taking into account the specified mass-scan speed in addition to the measurement mode of the MS/MS analysis to be performed and the specified pressure of the collision induced dissociation gas (CID gas pressure). A specific example of the mass calibration information which shows the relationship between the mass-to-charge ratio and the calibration value with the pressure of the collision induced dissociation gas and the mass-scan speed as the parameters is a plurality of two-dimensional tables each of which corresponds to one of a plurality of pressure values of the collision induced dissociation gas. Each of the two-dimensional tables shows the relationship between the calibration value with respect to the mass-scan speed and mass-to-charge ratio in an MS/MS analysis performed under the corresponding pressure of the collision induced dissociation gas. For example, the table has a number of cells in which each array of cells arranged in either the row or column direction are the fields for setting calibration values which respectively correspond to different mass-to-charge ratios while each array of cells arranged in the other direction are the fields for setting different values of the mass-scan speed.

In the previously described configuration, when the measurement is performed in a mode in which the mass-to-charge ratio of the ion to be allowed to pass through the front quadrupole and/or rear quadrupole is fixed (as in the case of the MRM or product-ion scan measurement), the mass calibration information corresponding to the lowest scan speed among the mass calibration information of the front quadrupole and/or rear quadrupole corresponding to that measurement mode is used.

The third aspect of the present invention aimed at solving the previously described problem is a triple quadrupole mass spectrometer having: an ion source for ionizing a sample; a front quadrupole for selecting, as a precursor ion, an ion having a specific mass-to-charge ratio from various ions produced by the ion source; a collision cell for causing dissociation of the precursor ion by making the precursor ion collide with collision induced dissociation gas; a rear quadrupole for selecting an ion having a specific mass-to-charge ratio from various product ions produced by the dissociation; and a detector for detecting the ion passing through the rear quadrupole, the triple quadrupole mass spectrometer including:

a) a calibration information storage section for storing mass calibration information showing the relationship between the mass-to-charge ratio and a calibration value, obtained by performing an analysis including the dissociation of the precursor ion in the collision cell for a standard sample having a known mass-to-charge ratio under a collision induced dissociation gas pressure specified by a user; and b) a controller for calibrating the mass-to-charge ratio of the ion to be detected by the detector, by reading the mass calibration information from the calibration information storage section and by driving each of the front quadrupole and the rear quadrupole using that information, when an MS/MS analysis of a target sample is performed using the aforementioned collision induced dissociation gas pressure.

Under normal situations, the "analysis including the dissociation of the precursor ion in the collision cell" in the previous description is an MS/MS analysis. The analysis may also be an MS analysis in which the selection of ions according to their mass-to-charge ratios is performed in only one of the front and rear quadrupoles (e.g. a front quadrupole scan measurement, which will be described later) with CID gas introduced in the collision cell. The "standard sample having a known mass-to-charge ratio" means a standard sample which will yield an ion (product ion) to be detected by the detector at a known mass-to-charge ratio when the "analysis including the dissociation of the precursor ion in the collision cell" is performed on that standard sample.

Unlike the first and second aspects of the present invention in which mass calibration information is stored for a plurality of pressures of the collision induced dissociation gas, in the third aspect of the present invention, only the mass calibration information related to the collision induced dissociation gas pressure specified by a user is stored in the calibration information storage section, and a mass calibration using this mass calibration information is performed when an MS/MS analysis of a target sample is performed under that pressure of the collision induced dissociation gas. This configuration is advantageous in that the amount of mass calibration information that needs to be held is further decreased. The "mass calibration information showing the relationship between the mass-to-charge ratio and a calibration value, obtained by performing an analysis including the dissociation of the precursor ion in the collision cell for a standard sample having a known mass-to-charge ratio under a collision induced dissociation gas pressure specified by a user" may be a set of information obtained by performing an analysis in a single measurement mode specified by the user "under a collision induced dissociation gas pressure specified by a user", or it may be a set of information obtained by performing analyses in various measurement modes under the "collision induced dissociation gas pressure specified by a user." In the former case, the controller reads, from the calibration information storage section, the mass calibration information obtained by performing that single measurement mode, and drives each of the front and rear quadrupoles based on that information. In the latter case, the mass calibration information stored in the calibration information storage section consists of a collection of information which describes, for each measurement mode, the relationship between the mass-to-charge ratio and the calibration value under the "collision induced dissociation gas pressure specified by a user." Therefore, the controller reads, from the calibration information storage section, the mass calibration information corresponding to the measurement mode of the MS/MS analysis to be performed, and drives each of the front and rear quadrupoles based on that information.

The mass calibration in the third aspect of the present invention may also preferably be performed taking into account the mass-scan speed in addition to the collision induced dissociation gas pressure. In this case, the mass calibration information is obtained by performing an analysis including a dissociation of the precursor ion in the collision cell for a standard sample while variously changing the mass-scan speed (or the measurement mode and the mass-scan speed) under a collision induced dissociation gas pressure specified by a user, and the thus obtained information is stored in the calibration information storage section. When an MS/MS analysis of a target sample is performed under the aforementioned collision induced dissociation gas pressure, the controller reads, from the calibration information storage section, the mass calibration information corresponding to the mass-scan speed (or the measurement mode and the mass-scan speed) to be applied in the analysis and calibrates the mass-to-charge ratio using that information.

In a preferable mode of the first, second or third aspect of the present invention, the calibration value includes a calibration value for adjusting the mass-resolving power in addition to the calibration value of the mass-to-charge ratio, and the controller performs an adjustment of the mass-resolving power concurrently with the calibration of the mass-to-charge ratio of the ion to be detected by the detector.

Advantageous Effects of the Invention

Thus, in the triple quadrupole mass spectrometer according to the present invention, even if an MS/MS analysis is performed under various pressures of the collision induced dissociation gas (CID gas pressures), the mass calibration is appropriately performed for each pressure of the collision induced dissociation gas, so that the discrepancy of the mass-to-charge ratio axis of the mass spectrum (MS/MS spectrum) is reduced. As a result, a mass spectrum with a high level of mass accuracy is obtained, and the accuracy of the quantitative determination or structural analysis of the target component is improved.

In the case of a system which does not only perform the appropriate mass calibration according to the pressure of the collision induced dissociation gas but also adjusts the mass-resolving power in the previously described manner, the deterioration in the mass resolution and/or sensitivity of the mass spectrum (MS/MS spectrum) is also reduced, so that the accuracy of the quantitative determination or structural analysis of the target component is further improved.

BRIEF DESCRIPTION OF DRAWINGS

FIG. 4 shows specific examples of the mass calibration table.

FIG. 5A is a peak profile waveform obtained with a conventional device and FIG. 5B is a peak profile waveform obtained with a device according to the present invention.

DESCRIPTION OF EMBODIMENTS

Figures 1, 2:
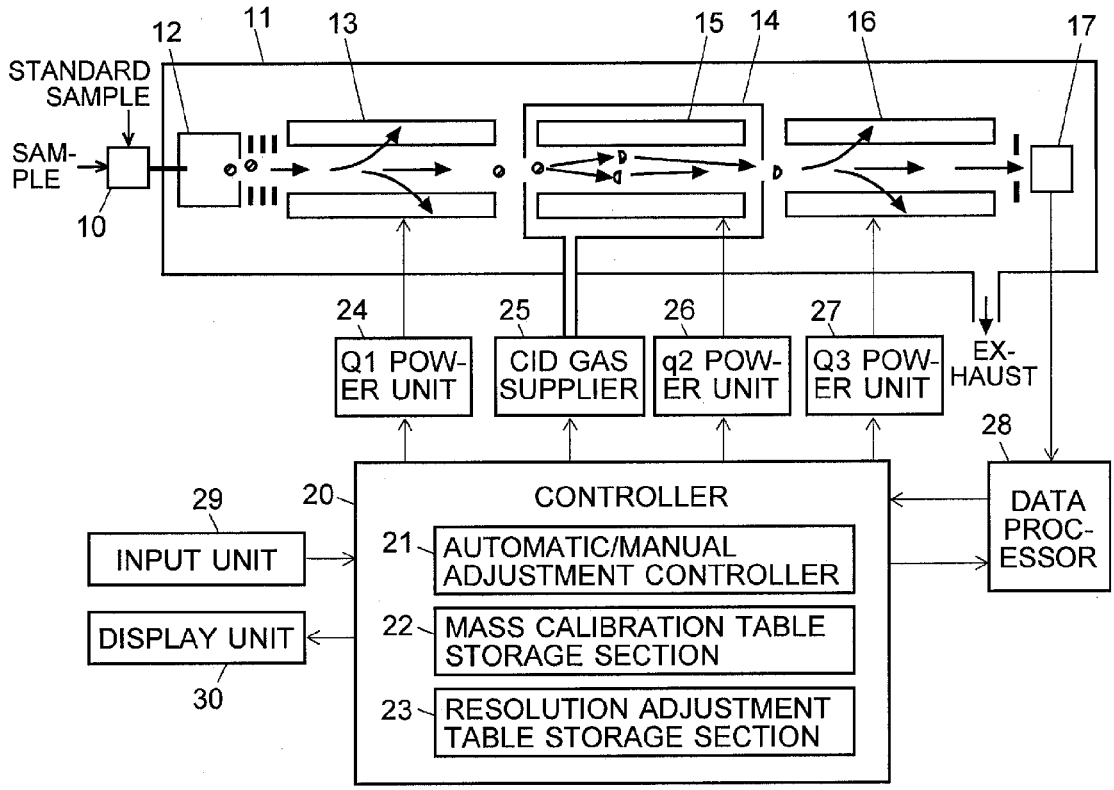
FIG. 1 is a schematic configuration diagram of a triple quadrupole mass spectrometer as one embodiment of the present invention.
FIG. 2 shows drive modes for the front quadrupole (Q1) and rear quadrupole (Q3) in MS analyses and MS/MS analyses.

A triple quadrupole mass spectrometer as one embodiment of the present invention is hereinafter described with reference to the attached drawing. FIG. 1 is a schematic configuration diagram of the triple quadrupole mass spectrometer of the present embodiment.

The triple quadrupole mass spectrometer of the present embodiment has an analysis chamber 11 evacuated with a vacuum pump (not shown), which contains: an ion source 12 for ionizing a sample to be analyzed; a front quadrupole mass filter (front quadrupole) 13 and a rear quadrupole mass filter (rear quadrupole) 16, each of which is composed of four rod electrodes; a collision cell 14 in which a multipole ion guide 15 is provided; and a detector 17 for detecting ions and producing detection signals corresponding to the amounts of the ions. A passage selector 10 performs a switching operation for supplying the ion source 12 with either a sample to be analyzed which is fed, for example, from a gas chromatograph (which is not shown) or a standard sample for calibration and adjustment. Various compounds can be used as the standard sample, such as PEG (polyethylene glycol), TFA (trifluoroacetic acid) and PFTBA (perfluorotributylamine). If the sample is a gas sample, a device which ionizes the sample by an EI (electron ionization), CI (chemical ionization) or similar method is used as the ion source 12. If the sample is a liquid sample, a device which ionizes the sample by an ESI (electrospray ionization), APCI (atmospheric pressure chemical ionization), APPI (atmospheric pressure photoionization) or similar atmospheric pressure ionization method is used as the ion source 12. In a system which ionizes the sample by an atmospheric pressure ionization method, the ion source 12 is placed outside the analysis chamber 11 and will not be evacuated by the vacuum pump. In this case, a desolvation unit is provided between the ion source 12 and the analysis chamber 11, and the ions generated by the ion source 12 are introduced through this desolvation unit into the analysis chamber 11.

A controller 20, to which an input unit 29 and a display unit 30 are connected, includes an automatic/manual adjustment controller 21, a mass calibration table storage section 22, a resolution adjustment table storage section 23 and other components. Under the command of this controller 20, predetermined amounts of voltage are applied from a Q1 power unit 24, q2 power unit 26 and Q3 power unit 27 to the front quadrupole 13, multipole ion guide 15 and rear quadrupole 16, respectively. Furthermore, under the command of the controller 20, collision induced dissociation gas (CID gas) composed of helium, argon or similar gas is supplied from a CID gas supplier 25 to the collision cell 14. The detection signals (ion intensity signals) produced by the detector 17 are fed to a data processor 28, which performs predetermined data processing to create mass spectra or other forms of information. It should be noted that the controller 20 and data processor 28 are the functional blocks realized by executing a dedicated controlling-and-processing software program installed on a personal computer provided as hardware.

As commonly known, each of the voltages applied from the Q1 and Q3 power units 24 and 27 to the front and rear quadrupoles 13 and 16 under the command of the controller 20 is composed of a radio-frequency voltage added to a DC voltage. The voltage applied from the q2 power unit 26 to the multipole ion guide 15 is a radio-frequency voltage for focusing ions. Normally, a DC bias voltage is additionally applied to the quadrupoles 13 and 16 as well as the ion guide 15.

In the triple quadrupole mass spectrometer of the present embodiment, four measurement modes are provided for normal MS analyses in which no ion-dissociating operation is performed in the collision cell 14: the front quadrupole SIM measurement, front quadrupole scan measurement, rear quadrupole SIM measurement, and rear quadrupole scan measurement. Furthermore, four measurement modes are provided for MS/MS analyses in which an ion-dissociating operation is performed in the collision cell 14: the MRM measurement, precursor-ion scan measurement, product-ion scan measurement, and neutral-loss scan measurement. FIG. 2 shows the drive modes for the front quadrupole (denoted as "Q1" in the FIG. 13 and rear quadrupole (denoted as "Q3" in the FIG. 16 in each measurement mode.

In FIG. 2, "SIM" means driving the quadrupole so that only an ion having a specified mass-to-charge ratio (m/z) can pass through it, as in the SIM measurement. "SCAN" means driving the quadrupole so that a mass scan is performed over a specified range of mass-to-charge ratios at a specified scan speed, as in the scan measurement. As is evident from FIG. 2, in an MS analysis, one of the front and rear quadrupoles 13 and 16 is set in either the SIM drive mode or scan drive mode. In an MS/MS analysis, each of the front and rear quadrupoles 13 and 16 is set in either the SIM drive mode or scan drive mode.

Figure 3:
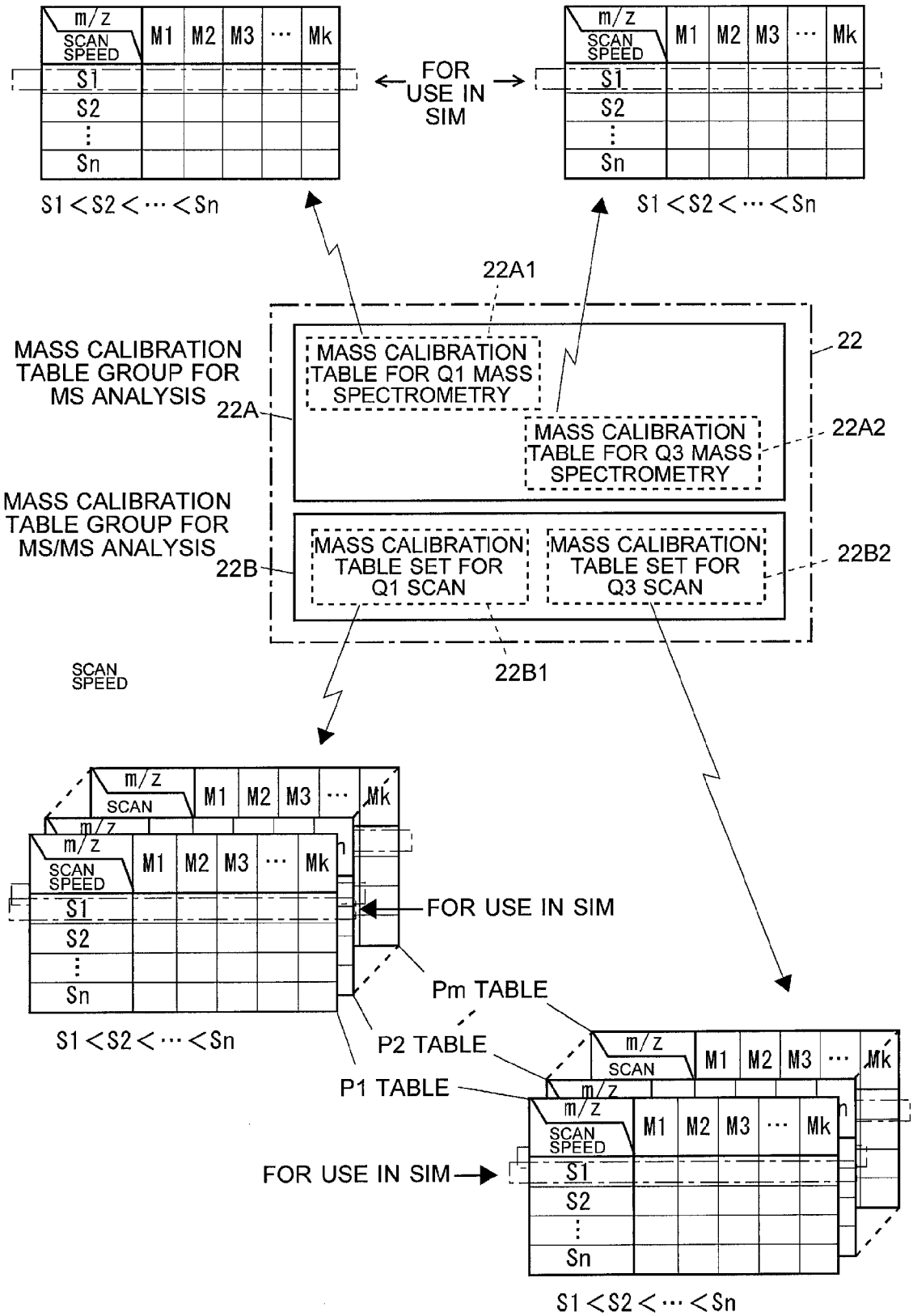
FIG. 3 is a model diagram showing the contents of the tables stored in a mass calibration table storage section.

FIG. 3 is a model diagram showing the contents of the tables stored in the mass calibration table storage section 22. As shown, the tables stored in the mass calibration table storage section 22 are roughly divided into a mass calibration table group 22A for MS analysis and a mass calibration table group 22B for MS/MS analysis. The mass calibration table group 22A for MS analysis includes two mass calibration tables: a mass calibration table 22A1 for Q1 mass spectrometry and a mass calibration table 22A2 for Q3 mass spectrometry. On the other hand, the mass calibration table group 22B for MS/MS analysis includes a mass calibration table set 22B1 for Q1 scan and a mass calibration table set 22B2 for Q3 scan, each of which consist of a plurality of mass calibration tables.

One mass calibration table is a two-dimensional table holding mass deviation values written in a set of cells arranged in rows and columns, with each row corresponding to one of the different scan speeds (S1, S2, . . . , and Sn) as one parameter and each column corresponding to one of the different mass-to-charge ratios (M1, M2, . . . , and Mk) as another parameter.

This table can be regarded as describing the relationship between the mass-to-charge ratio and the mass deviation for each scan speed. In the mass calibration for an MS analysis, it is unnecessary to consider the CID gas pressure, since an MS analysis includes no ion-dissociating operation to be performed in the collision cell 14.

The plurality of mass calibration tables included in the mass calibration table set 22B1 for Q1 scan or mass calibration table set 22B2 for Q3 scan include a plurality of two-dimensional tables each of which is similar to the previously described table and holds mass deviation values written in a set of cells arranged in rows and columns, with each row corresponding to one of the different scan speeds (S1, S2, . . . , and Sn) as one parameter, each column corresponding to one of the different mass-to-charge ratios (M1, M2, . . . , and Mk) as another parameter, and each mass calibration table corresponding to one of the different CID gas pressures (P1, P2, . . . , and Pm) (see FIG. 3). That is to say, these mass calibration table sets 22B1 and 22B2 can be regarded as describing the relationship between the mass-to-charge ratio and the mass deviation for each of the various combinations of the CID pressures and the scan speeds.

FIG. 4 shows an example of one of the plurality of mass calibration tables included in each of the two mass calibration table sets 22B1 and 22B2 belonging to the mass calibration table group 22B for MS/MS analysis. For example, the upper mass calibration table in this figure is one of the mass calibration tables belonging to the mass calibration table set 22B1 for Q1 scan. Specifically, this table shows mass calibration values to be applied when the CID gas pressure is 200 kPa. The cells in the first row of this table show, from left to right, the mass deviation values to be applied at m/z 65.05, m/z 168.10, m/z 344.20, m/z 652.40, m/z 1004.60 and m/z 1312.80 when the scan speed is at the lowest value, 125 u/s.

In the triple quadrupole mass spectrometer of the present embodiment, the previously described mass calibration tables are prepared beforehand based on the result of an analysis of a standard sample at an appropriate point in time before a measurement for a target sample is performed. Two methods for creating the mass calibration tables (i.e. for determining the mass deviation value for each mass-to-charge ratio) are available: automatic adjustment and manual adjustment. The procedure for creating the mass calibration tables by automatic adjustment is as follows:

(1) Creation of Mass Calibration Table for Q1 Mass Spectrometry

When a command for the automatic adjustment is given, the automatic/manual adjustment controller 21 operates the passage selector 10 so that the standard sample will be continuously introduced into the ion source 12. It also controls the Q3 power unit 27 so that ions will directly pass through the rear quadrupole 16 (i.e. so that no selection according to their mass-to-charge ratios will be performed). In this case, no ion-selection voltage is applied from the Q3 power unit 27 to the rear quadrupole 16, or a voltage that makes the rear quadrupole 16 function as a mere ion guide is applied. Meanwhile, the supply of the CID gas to the collision cell 14 is halted; or if the supply of the CID gas is necessary, the bias voltage applied to the collision cell 14 is regulated to decrease the amount of collision energy, so as to suppress the ion-dissociating effect of the collision cell 14 and thereby achieve a sufficiently high level of peak sensitivity at the mass-to-charge ratio to be used for the adjustment. Under such a condition, the automatic/manual adjustment controller 21 operates the Q1 power unit 24 so that the mass scan over a predetermined range of mass-to-charge ratios will be performed in the front quadrupole 13 at a plurality of scan speeds S1, S2, . . . , Sn. The voltage applied to the front quadrupole 13 in this operation is determined, for example, according to the default value that is already set when the present system is delivered to users.

The data processor 28 determines the peak profile over the predetermined range of mass to-charge ratios for each scan speed based on the detection signals obtained from the detector 17 for each mass scan cycle. Normally, one peak profile is created by accumulating the data obtained through a plurality of times of the scan measurement performed at the same scan speed. This peak profile shows the continuous relationship between the mass-to-charge ratio and the signal intensity of the ions detected in the mass-scan process. A peak waveform corresponding to each standard component contained in the standard sample is observed on the peak profile.

The accurate mass-to-charge ratio (e.g. the theoretical value) of the standard component is previously known. If there is no mass deviation, the measured value of the mass-to-charge ratio determined from the peak position (e.g. the position of the center of the mass of the peak waveform) of the standard component observed on the peak profile should agree with the theoretical value of the mass-to-charge ratio. Actually, however, due to various factors, each individual system has a specific mass deviation, or even in the same system, the mass deviation can fluctuate with the elapse of time and/or depending on the surrounding environment. Therefore, the automatic/manual adjustment controller 21 calculates the mass deviation value, i.e. the difference between the measured and theoretical values, for each mass-to-charge ratio at which the peak of the standard component appears. The obtained values are adopted as the mass deviation values to be written in the mass calibration table 22A1 for Q1 mass spectrometry.

(2) Creation of Mass Calibration Table for Q3 Mass Spectrometry

Next, the automatic/manual adjustment controller 21 operates the Q1 power unit 24 so that ions will directly pass through the front quadrupole 13 (i.e. so that no selection according to their mass-to-charge ratios will be performed). In this case, no ion-selection voltage is applied from the Q1 power unit 24 to the front quadrupole 13, or a voltage which makes the front quadrupole 13 function as a mere ion guide is applied. Under such a condition, the automatic/manual adjustment controller 21 operates the Q3 power unit 27 so that the mass scan over a predetermined range of mass-to-charge ratios will be performed in the rear quadrupole 16 at a plurality of scan speeds Si, S2, . . . , Sn. The voltage applied to the rear quadrupole 16 in this operation is also determined, for example, according to the default value that is already set when the present system is delivered to users.

As in the case of the mass scan in the front quadrupole 13, the data processor 28 determines the peak profile over the predetermined range of mass to-charge ratios for each scan speed, based on the detection signals obtained from the detector 17 for each mass scan cycle. The automatic/manual adjustment controller 21 calculates the mass deviation value, i.e. the difference between the measured and theoretical values, for each mass-to-charge ratio at which the peak of the standard component appears. The obtained values are adopted as the mass deviation values to be written in the mass calibration table 22A2 for Q3 mass spectrometry.

When the triple quadrupole mass spectrometer is operated to perform an MS analysis in which the selection of ions according to their mass-to-charge ratios is performed in only one of the front and rear quadrupoles 13 and 16, the ion which has passed through the front quadrupole 13 should be introduced into the rear quadrupole 16 without undergoing the collision induced dissociation in the collision cell 14. Therefore, as noted earlier, in the process of creating the mass calibration table 22A1 for Q1 mass spectrometry and the mass calibration table 22A2 for Q3 mass spectrometry belonging to the mass calibration table group 22A for MS analysis, the peak profile is obtained under the condition that the ion-dissociating effect in the collision cell 14 is lowered by halting the supply of the CID gas to the collision cell 14, or if the supply of the CID gas is necessary, by regulating the bias voltage applied to the collision cell 14 to decrease the amount of collision energy.

On the other hand, in the case of an MS/MS analysis, the ion which has passed through the front quadrupole 13 is introduced into the rear quadrupole 16 after undergoing the collision induced dissociation in the collision cell 14, where the passing speed of the ion decreases due to the collision with the CID gas. The higher the CID gas pressure in the collision cell 14 is, the greater the amount of decrease in the passing speed is. Therefore, if a mass calibration value obtained under a certain CID gas pressure is used in an MS/MS analysis of a target sample which is performed under a different CID gas pressure, a discrepancy of the mass-to-charge ratio axis will occur. Therefore, in the triple quadrupole mass spectrometer of the present embodiment, the mass calibration table set 22B1 for Q1 scan and the mass calibration table set 22B2 for Q3 scan belonging to the mass calibration table group 22B for MS/MS analysis are created by determining a peak profile as described earlier for each of a plurality of CID gas pressures. The procedure for creating these table sets 22B1 and 22B2 is hereinafter described.

(3) Creation of Mass Calibration Table Set for Q1 Scan

Initially, the automatic/manual adjustment controller 21 operates the passage selector 10 so that the standard sample will be continuously introduced into the ion source 12, and it also operates the Q3 power unit 27 so that ions will directly pass through the rear quadrupole 16 (i.e. so that no selection according to their mass-to-charge ratios will be performed). Furthermore, the automatic/manual adjustment controller 21 controls the supply of the CID gas from the CID gas supplier 25 to the collision cell 14 so that the CID gas pressure in the collision cell 14 will be a predetermined value (P1). Then, the mass scan in the front quadrupole 13 as well as the creation of the peak file and the calculation of the mass deviation value by the data processor 28 are performed in the previously described manner. That is to say, the automatic/manual adjustment controller 21 operates the Q1 power unit 24 so that the mass scan over a predetermined range of mass-to-charge ratios will be performed at a plurality of scan speeds S1, S2, . . . , and Sn in the front quadrupole 13. Then, the data processor 28 determines the peak profile over the predetermined range of mass to-charge ratios for each scan speed based on the detection signals obtained from the detector 17 for each mass scan cycle, and calculates the mass deviation value, i.e. the difference between the measured and theoretical values, for each mass-to-charge ratio at which the peak of the standard component appears. The obtained values are adopted as the mass deviation values to be written in the "P1 Table" included in the mass calibration table set 22B1 for Q1 scan.

Subsequently, the automatic/manual adjustment controller 21 changes the CID gas pressure in the collision cell 14 to P2, P3, . . . , and Pm in a stepwise manner by controlling the CID gas supplier 25. In each step, it performs the mass scan and calculates the peak profile and the mass deviation value in the previously described manner. The mass deviation values thus obtained are written in each of the mass calibration tables (i.e. "P2 Table", . . . , "Pm Table" in the figure) included in the mass calibration table set 22B1 for Q1 scan.

(4) Creation of Mass Calibration Table Set for Q3 Scan

Next, the automatic/manual adjustment controller 21 operates the Q1 power unit 24 so that ions will directly pass through the front quadrupole 13 (i.e. so that no selection according to their mass-to-charge ratios will be performed). Furthermore, the automatic/manual adjustment controller 21 controls the supply of the CID gas from the CID gas supplier 25 to the collision cell 14 so that the CID gas pressure in the collision cell 14 will be a predetermined value (P1). Then, similarly to the previous case, it performs the mass scan at a plurality of scan speeds S1, S2, . . . , and Sn in the rear quadrupole 16 as well as the creation of the peak profile and the calculation of the mass deviation values at each scan speed by the data processor 28. The obtained values are adopted as the mass deviation values to be written in the "P1 Table" included in the mass calibration table set 22B2 for Q3 scan.

Subsequently, the automatic/manual adjustment controller 21 changes the CID gas pressure in the collision cell 14 to P2, P3, . . . , and Pm in a stepwise manner by controlling the CID gas supplier 25. In each step, similarly to the previous case, it performs the mass scan in the rear quadrupole 16 and calculates the peak profile and the mass deviation value in the previously described manner. The mass deviation values thus obtained are written in each of the mass calibration tables (i.e. "P2 Table", . . . , "Pm Table") included in the mass calibration table set 22B2 for Q3 scan.

Thus, all the mass calibration tables 22A1 and 22A2 as well as the mass calibration table sets 22B1 and 22B2 shown in FIG. 3 are completed.

On the other hand, if the shape of the actually measured peak profile is rather deficient due to a comparatively low degree of purity of the standard sample or other factors, the previously described automatic adjustment may be incapable of providing a sufficient level of calibration accuracy. Furthermore, depending on the purpose of the analysis or for other reasons, users may desire to conduct an analysis on a specific component with a high level of accuracy, and such an analysis may require a higher level of accuracy than the mass calibration by the automatic adjustment. In such a case, the manual mass calibration is performed by users themselves or by field service representatives. When a command for performing the manual adjustment is given, the automatic/manual adjustment controller 21 displays, on the screen of the display unit 30, a mass calibration table as shown in FIG. 4 as well as a peak profile at an arbitrary scan speed and mass-to-charge ratio in this table.

The user selects an arbitrary cell in the displayed mass calibration table to display a peak profile near the mass-to-charge ratio corresponding to that cell. Then, the user appropriately rewrites the mass deviation value in the selected cell so as to bring the target centroid peak to the center of the horizontal axis (mass-to-charge ratio axis) in the display frame of the peak profile waveform. By this operation, the calibration value for that mass-to-charge ratio is determined Similarly, based on his or her own experience, the user can adjust the calibration value at the peak for each different combination of the mass-to-charge ratio and the scan speed until all the calibration values held in the cells of the mass calibration table are determined Such a manual adjustment allows the user to visually check the change in the peak waveform and accurately determine the mass deviation for each peak. To perform the manual adjustment more efficiently, for example, a method proposed in JP 2012-043721 A by the present applicant may be used.

Next, an operation of performing an analysis of a target sample using the mass calibration tables 22A1 and 22A2 as well as the mass calibration table sets 22B1 and 22B2 held in the mass calibration table storage section 22 in the previously described manner is described. As one example, the following description deals with the case of performing a product-ion scan measurement for the target sample.

In the case of the product-ion scan measurement, the mass-to-charge ratio range and the scan speed in the rear quadrupole 16, the mass-to-charge ratio of the precursor ion and other analysis condition parameters are set through the input unit 29. However, as already noted, in the case where the product-ion scan measurement is triggered by an MRM or normal scan measurement, the mass-to-charge ratio of the precursor ion and some other parameters are automatically determined based on the result of the MRM or normal scan measurement. Additionally, as one of the analysis condition parameters, the CID gas pressure is also set through the input unit 29 in order to achieve an appropriate CID efficiency in the collision cell. In the hereinafter described example, it is assumed that the analysis condition parameters are set as follows: range of mass-to-charge ratios in the rear quadrupole 16, m/z 70-1300; scan speed, 2000 u/s; mass-to-charge ratio of the precursor ion, m/z 1200; and CID gas pressure, 200 kPa.

The controller 20 refers to the mass calibration table corresponding to a CID gas pressure of 200 kPa in the mass calibration table set 22B1 for Q1 scan held in the mass calibration table storage section 22 and reads the calibration values corresponding to the lowest scan speed in the table, 125 u/s. That is to say, the calibration values in the first row in the upper table in FIG. 4 (−0.94, −0.84, . . . ) are read. From these calibration values which correspond to the different mass-to-charge ratios, a calibration value corresponding to the mass-to-charge ratio of the target precursor ion, i.e. m/z 1200, is calculated by interpolation or other operations. The reason why the calibration values corresponding to the lowest scan speed 125 u/s are used is because, in the product-ion scan measurement, the front quadrupole 13 is driven in the SIM drive mode, as shown in FIG. 2. Using the calibration value thus calculated, the controller 20 operates the Q1 power unit 24 so that the ion having a mass-to-charge ratio of m/z 1200 will be selectively allowed to pass through the front quadrupole 13.

The controller 20 also refers to the mass calibration table corresponding to a CID gas pressure of 200 kPa in the mass calibration table set 22B2 for Q3 scan held in the mass calibration table storage section 22 and reads the calibration values corresponding to the specified scan speed, 2000 u/s. That is to say, the calibration values in the fifth row in the lower table in FIG. 4 (−0.79,−0.69, −0.48, . . . ) are read. Using the read calibration values, the controller 20 operates the Q3 power unit 27 so that a mass scan over a range of mass-to-charge ratios from m/z 70 to 1300 will be repeated at a scan speed of 2000 u/s in the rear quadrupole 16.

After each of the front and rear quadrupoles 13 and 16 is set in the previously described manner, a target sample is introduced into the ion source 12. Then, the components in the sample are ionized in the ion source 12. Among the various ions thereby produced, only an ion having a mass-to-charge ratio of m/z 1200 is selectively allowed to pass through the front quadrupole 13 and be introduced into the collision cell 14 as the precursor ion. In this collision cell 14, CID gas is continuously introduced from the CID gas supplier 25 so as to maintain the CID gas pressure in the cell at 200 kPa. Due to the collision with this CID gas, the precursor ion undergoes dissociation, whereby various product ions are produced. Those product ions are transported and focused by the radio-frequency electric field formed by the multipole ion guide 15, to be sent into the rear quadrupole 16. As described previously, the rear quadrupole 16 is operated to perform the mass scan, whereby only a product ion having a mass-to-charge ratio which satisfies the passing conditions among the various product ions can pass through the rear quadrupole 16, to eventually reach and be detected by the detector 17. The data processor 28 receives detection signals from the detector 17 and creates a peak profile covering a predetermined range of mass-to-charge ratios. Furthermore, it determines the centroid peak of each peak waveform to create a mass spectrum (an MS/MS spectrum for the precursor ion of m/z 1200).

The previously described example is one of the cases where the mass calibration table corresponding to the CID gas pressure specified as an analysis condition parameter is included in the mass calibration table set 22B1 for Q1 scan and the mass calibration table set 22B2 for Q3 scan. If the mass calibration table corresponding to the CID gas pressure specified as an analysis condition parameter is not included in the table sets 22B1 and 22B2, the calibration values corresponding to the desired CID gas pressure can be calculated by interpolation from the calibration values held in an appropriate pair of mass calibration tables included in each table set 22B1 or 22B2. Similarly, if a scan speed which is not registered in the mass calibration tables is specified (e.g. 1750 u/s in the case of FIG. 4), the calibration values corresponding to the desired scan speed can be calculated by interpolation from the calibration values in the mass calibration table concerned.

In the case of the MRM measurement, since no mass scan is performed, both the front quadrupole 13 and the rear quadrupole 16 are driven in the SIM drive mode. Therefore, the drive control of the front quadrupole 13 uses the calibration values which correspond to the lowest scan speed 125 u/s in the mass calibration table corresponding to the CID gas pressure specified by a user among the mass calibration table set 22B1 for Q1 scan held in the mass calibration table storage section 22, while the drive control of the rear quadrupole 16 uses the calibration values which correspond to the lowest scan speed 125 u/s in the mass calibration table corresponding to the aforementioned CID gas pressure among the mass calibration table set 22B2 for Q3 scan. The reason why the calibration values corresponding to the lowest scan speed 125 u/s are used is because it is previously confirmed that the calibration values corresponding to the lowest scan speed 125 u/s are commonly applicable at any scan speeds lower than that value. Therefore, if it is previously confirmed that there is an even higher scan speed which also has the same set of calibration values, those calibration values corresponding to that higher scan speed may be selected in place of the calibration values corresponding to the lowest scan speed in the mass calibration table.

In the case of the neutral-loss scan measurement, both the front quadrupole 13 and the rear quadrupole 16 are driven in the scan drive mode. Accordingly, the drive control of the front quadrupole 13 uses the calibration values which correspond to the scan speed specified as the scan speed for the front quadrupole 13 in the mass calibration table corresponding to the CID gas pressure specified by the user among the mass calibration table set 22B1 for Q1 scan held in the mass calibration table storage section 22, while the drive control of the rear quadrupole 16 uses the calibration values which correspond to the scan speed specified as the scan speed for the rear quadrupole 16 in the mass calibration table corresponding to the aforementioned CID gas pressure among the mass calibration table set 22B2 for Q3 scan.

In the case where the analysis to be performed is not an MS/MS analysis but an MS analysis which does not include an ion-dissociating operation, either the mass calibration table 22A1 for Q1 mass spectrometry or mass calibration table 22A2 for Q3 mass spectrometry held in the mass calibration table storage section 22 is selected according to the measurement mode as described in FIG. 2, and the calibration values corresponding to the specified scan speed or those corresponding to the lowest scan speed 125 u/s are read from the selected table and used for driving the front quadrupole 13 or rear quadrupole 16.

Although the previous descriptions are only concerned with the mass calibration, a similar control is also performed to adjust the mass-resolving power, using the resolution-adjusting values written in the tables each of which shows the relationship between the mass-to-charge ratio and the resolution-adjusting value with the scan speed as the parameter, where the tables are divided into two independent groups stored in the resolution adjustment table storage section 23, one group for the MS analysis and the other for the MS/MS analysis, with each group including a table or tables for the front quadrupole 13 and a table or tables for the rear quadrupole 16 independent from each other. Consequently, a mass spectrum which is acceptable in both the mass accuracy and the mass resolution can be obtained.

Figure 5A:
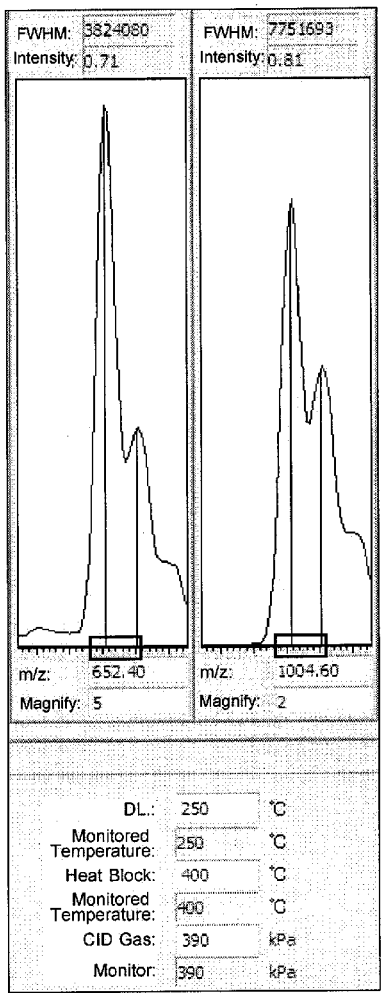
FIGS. 5A and 5B show measurement examples obtained with triple quadrupole mass spectrometers, where
Figure 5B:
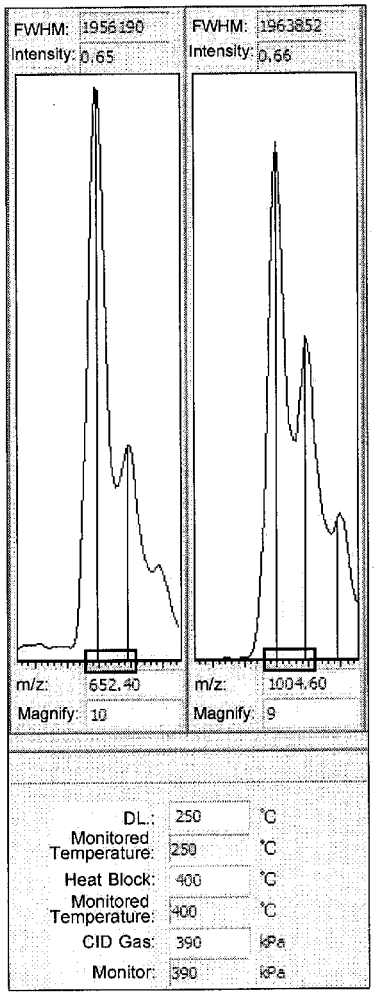
Figure 6A:
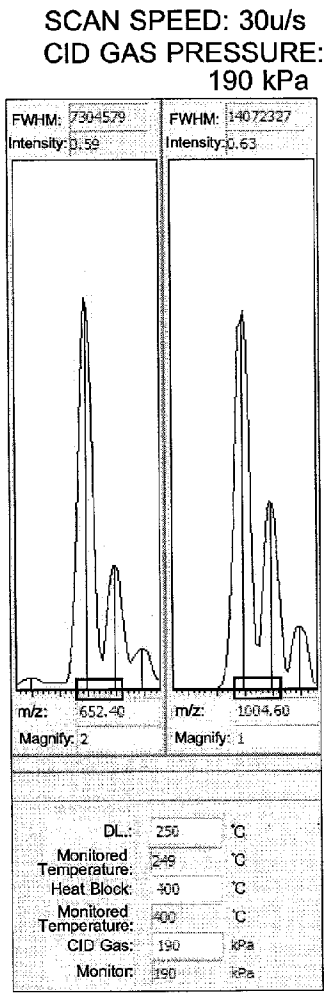
FIGS. 6A, 6B, 6C, and 6D show measurement examples obtained with a conventional triple quadrupole mass spectrometer.
Figure 6B:
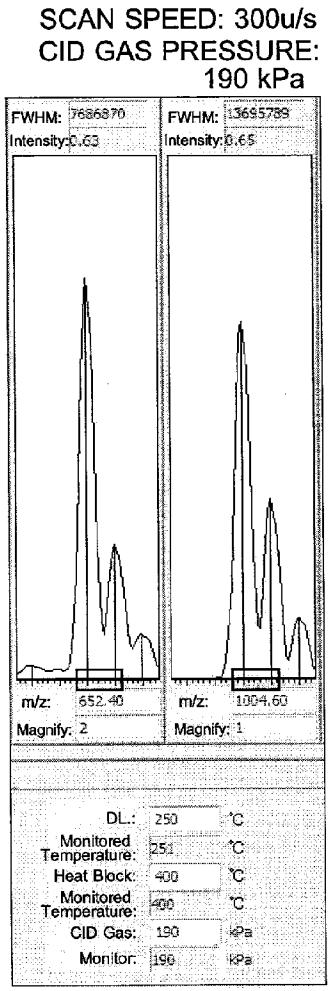
Figure 6C:
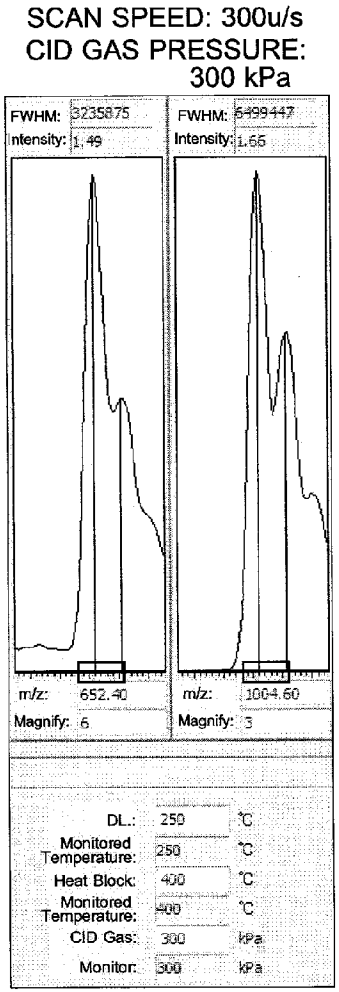
Figure 6D:
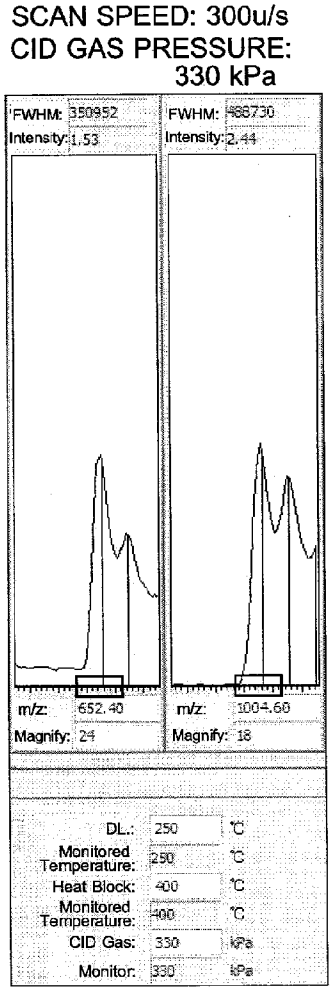

FIGS. 5A and 5B show specific peak profile waveforms obtained by actual measurements. It should be noted that, for ease of observation of the discrepancy in the mass-to-charge ratio axis, these figures show the results obtained by measurements performed in the Q1-scan measurement with CID gas introduced in the collision cell, although the present invention produces particularly noticeable effects in an MS/MS analysis including an ion-dissociating operation in the collision cell. In case of FIG. 5A, the mass calibration and resolution adjustment according to a conventional method with the scan speed as the parameter was performed as in the case of FIGS. 6A, 6B, 6C, and 6D, while in case of FIG. 5B the mass calibration and resolution adjustment according to the present invention with the CID gas pressure and the scan speed as the parameters was performed. In both cases, the CID gas pressure in the measurement was 390 kPa, and the scan speed of the front quadrupole was 30 u/s. As shown in FIG. 5A, when the conventional mass calibration was performed, the centroid peaks indicated by the vertical lines were displaced from the center of the horizontal axis of the graph, which indicates that there was a significant discrepancy in the mass-to-charge ratio. By contrast, when the mass calibration according to the present embodiment was performed, as shown in FIG. 5B, a centroid peak was approximately located at the center of the horizontal axis of the graph, which means that there was only a small discrepancy in the mass-to-charge ratio. Furthermore, the peaks shown in FIG. 5B are more distinct than those in FIG. 5A, which indicates that the mass-resolving power was also correctly adjusted.

As described thus far, the triple quadrupole mass spectrometer of the present embodiment can maintain its mass accuracy and mass-resolving power at high levels over a wide range of CID gas pressures from low to high CID gas pressures without requiring any readjustment by users. Therefore, for example, it is possible to appropriately combine and simultaneously perform various analyses ranging from an analysis using a low CID gas pressure to an analysis using a high CID gas pressure.

In the previous embodiment, there are only two table sets prepared for MS/MS analyses, i.e. the table set for mass calibration in the front quadrupole 13 (the mass calibration table set 22B1 for Q1 scan) and the table set for mass calibration in the rear quadrupole 16 (the mass calibration table set 22B2 for Q3 scan), and the two table sets are commonly used in any measurement mode. This is advantageous for reducing the quantity of memory used in the mass calibration table storage section 22. However, it does not allow using a different set of calibration values for each measurement mode among various MS/MS analyses. Accordingly, as a modified example, it is possible to prepare one mass calibration table set for each measurement mode. In that case, it is preferable to initially set the same set of calibration values for different measurement modes in the automatic adjustment and then allow those calibration values to be changed for each measurement mode by the manual adjustment.

Furthermore, in the previous embodiment, a plurality of mass calibration tables corresponding to various CID gas pressures are stored in the mass calibration storage section 22. However, the present invention is not limited to this configuration. For example, it is possible to perform an analysis on a standard sample having a known mass-to-charge ratio, including the dissociation of the precursor ion in the collision cell under a CID gas pressure specified by the user, before an MS/MS analysis of a target sample, and to store, in the mass calibration table storage section 22, a mass calibration table which is obtained from the measured result and which shows the relationship between the mass-to-charge ratio and the calibration value under that CID gas pressure. In this case, when an MS/MS analysis of the target sample is performed, the controller 20 calibrates the mass-to-charge ratio of the ions detected by the detector 17 by reading the aforementioned mass calibration table from the mass calibration table storage section 22 and controlling each of the Q1 and Q3 power units 24 and 27 based on the calibration values written in that table.

It should be noted that the previous embodiment is a mere example of the present invention, and any change, addition or modification appropriately made within the spirit of the present invention will evidently fall within the scope of claims of the present application.

REFERENCE SIGNS LIST

10 . . . Passage Selector
11 . . . Analysis Chamber
12 . . . Ion Source
13 . . . Front Quadrupole
14 . . . Collision Cell
15 . . . Multipole Ion Guide
16 . . . Rear Quadrupole
17 . . . Detector
21 . . . Automatic/Manual Adjustment Controller
20 . . . Controller
22 . . . Mass Calibration Table Storage Section
  22A . . . Mass Calibration Table Group for MS Analysis
  22A1 . . . Mass Calibration Table for Q1 Mass Spectrometry
  22A2 . . . Mass Calibration Table for Q3 Mass Spectrometry
  22B . . . Mass Calibration Table Group for MS/MS Analysis
  22B1 . . . Mass Calibration Table Set for Q1 Scan
  22B2 . . . Mass Calibration Table Set for Q3 Scan
23 . . . Resolution Adjustment Table Storage Section
24 . . . Q1 Power Unit
25 . . . CID Gas Supplier
26 . . . q2 Power Unit
27 . . . Q3 Power Unit
28 . . . Data Processor

29 . . . Input Unit
30 . . . Display Unit

The invention claimed is:

1. A triple quadrupole mass spectrometer having: an ion source for ionizing a sample; a front quadrupole for selecting, as a precursor ion, an ion having a specific mass-to-charge ratio from various ions produced by the ion source; a collision cell for causing dissociation of the precursor ion by making the precursor ion collide with collision induced dissociation gas; a rear quadrupole for selecting an ion having a specific mass-to-charge ratio from various product ions produced by the dissociation; and a detector for detecting the ion passing through the rear quadrupole, the triple quadrupole mass spectrometer comprising:

a) a calibration information storage section for storing mass calibration information showing a relationship between the mass-to-charge ratio and a calibration value, with a pressure of a collision induced dissociation gas as a parameter, for each measurement mode of an MS/MS analysis including a dissociating operation using the collision cell; and b) a controller for calibrating the mass-to-charge ratio of the ion to be detected by the detector, by reading, from the calibration information storage section, the mass calibration information corresponding to the measurement mode to be performed and a specified pressure of the collision induced dissociation gas and by driving each of the front quadrupole and the rear quadrupole using that information.

2. The triple quadrupole mass spectrometer according to claim 1, wherein the calibration information storage section holds, as the aforementioned mass calibration information, mass calibration information showing the relationship between the mass-to-charge ratio and the calibration value with a mass-scan speed as a parameter in addition to the pressure of the collision induced dissociation gas.

3. The triple quadrupole mass spectrometer according to claim 2, wherein the calibration information storage section holds, as the aforementioned mass calibration information, mass calibration information showing the relationship between the mass-to-charge ratio and the calibration value with a mass-scan speed as a parameter in addition to the pressure of the collision induced dissociation gas.

4. The triple quadrupole mass spectrometer according to claim 1, wherein the calibration value includes a calibration value for adjusting the mass-resolving power in addition to the calibration value of the mass-to-charge ratio, and the controller performs an adjustment of the mass-resolving power concurrently with the calibration of the mass-to-charge ratio of the ion to be detected by the detector.

5. A triple quadrupole mass spectrometer having: an ion source for ionizing a sample; a front quadrupole for selecting, as a precursor ion, an ion having a specific mass-to-charge ratio from various ions produced by the ion source; a collision cell for causing dissociation of the precursor ion; a rear quadrupole for selecting an ion having a specific mass-to-charge ratio from various product ions produced by the dissociation; and a detector for detecting the ion passing through the rear quadrupole, the triple quadrupole mass spectrometer comprising:

a) a calibration information storage section for storing mass calibration information showing a relationship between the mass-to-charge ratio and a calibration value with a pressure of a collision induced dissociation gas in a case of performing a mass scan of the front quadrupole as a parameter and mass calibration information showing the relationship between the mass-to-charge ratio and the calibration value with the pressure of the collision induced dissociation gas in a case of performing a mass scan of the rear quadrupole as a parameter in an MS/MS analysis including a dissociating operation using the collision cell; and b) a controller for calibrating the mass-to-charge ratio of the ion to be detected by the detector, by selecting, according to a measurement mode of an MS/MS analysis to be performed, a necessary combination from among the mass calibration information stored in the calibration information storage section, by reading the mass calibration information corresponding to a specified pressure of the collision induced dissociation gas and by driving each of the front quadrupole and the rear quadrupole using that information.

6. The triple quadrupole mass spectrometer according to claim 5, wherein the calibration value includes a calibration value for adjusting the mass-resolving power in addition to the calibration value of the mass-to-charge ratio, and the controller performs an adjustment of the mass-resolving power concurrently with the calibration of the mass-to-charge ratio of the ion to be detected by the detector.

7. A triple quadrupole mass spectrometer having: an ion source for ionizing a sample; a front quadrupole for selecting, as a precursor ion, an ion having a specific mass-to-charge ratio from various ions produced by the ion source; a collision cell for causing dissociation of the precursor ion by making the precursor ion collide with collision induced dissociation gas; a rear quadrupole for selecting an ion having a specific mass-to-charge ratio from various product ions produced by the dissociation; and a detector for detecting the ion passing through the rear quadrupole, the triple quadrupole mass spectrometer comprising:

a) a calibration information storage section for storing mass calibration information showing a relationship between the mass-to-charge ratio and a calibration value, obtained by performing an analysis including the dissociation of the precursor ion in the collision cell for a standard sample having a known mass-to-charge ratio under a collision induced dissociation gas pressure specified by a user; and b) a controller for calibrating the mass-to-charge ratio of the ion to be detected by the detector, by reading the mass calibration information from the calibration information storage section and by driving each of the front quadrupole and the rear quadrupole using that information, when an MS/MS analysis of a target sample is performed using the aforementioned collision induced dissociation gas pressure.

8. The triple quadrupole mass spectrometer according to claim 7, wherein the calibration value includes a calibration value for adjusting the mass-resolving power in addition to the calibration value of the mass-to-charge ratio, and the controller performs an adjustment of the mass-resolving power concurrently with the calibration of the mass-to-charge ratio of the ion to be detected by the detector.

9. A non-transitory computer-readable medium recording a program for a triple quadrupole mass spectrometer, the program provided for use in a triple quadrupole mass spectrometer having: an ion source for ionizing a sample; a front quadrupole for selecting, as a precursor ion, an ion having a specific mass-to-charge ratio from various ions produced by the ion source; a collision cell for causing dissociation of the precursor ion by making the precursor ion collide with collision induced dissociation gas; a rear quadrupole for selecting an ion having a specific mass-to-charge ratio from various product ions produced by the dissociation; and a detector for detecting the ion passing through the rear quadrupole, and the program configured to make a computer function as:

a) a calibration information storage section for storing mass calibration information showing a relationship between the mass-to-charge ratio and a calibration value, with a pressure of a collision induced dissociation gas as a parameter, for each measurement mode of an MS/MS analysis including a dissociating operation using the collision cell; and b) a controller for calibrating the mass-to-charge ratio of the ion to be detected by the detector, by reading, from the calibration information storage section, the mass calibration information corresponding to the measurement mode to be performed and a specified pressure of the collision induced dissociation gas and by driving each of the front quadrupole and the rear quadrupole using that information.

10. The non-transitory computer-readable medium recording a program for a triple quadrupole mass spectrometer according to claim 9, wherein the calibration information storage section holds, as the aforementioned mass calibration information, mass calibration information showing the relationship between the mass-to-charge ratio and the calibration value with a mass-scan speed as a parameter in addition to the pressure of the collision induced dissociation gas.

11. The non-transitory computer-readable medium recording a program for a triple quadrupole mass spectrometer according to claim 9, wherein:

the calibration value includes a calibration value for adjusting the mass-resolving power in addition to the calibration value of the mass-to-charge ratio; and the controller performs an adjustment of the mass-resolving power concurrently with the calibration of the mass-to-charge ratio of the ion to be detected by the detector.

12. A non-transitory computer-readable medium recording a program for a triple quadrupole mass spectrometer, the program provided for use in a triple quadrupole mass spectrometer having: an ion source for ionizing a sample; a front quadrupole for selecting, as a precursor ion, an ion having a specific mass-to-charge ratio from various ions produced by the ion source; a collision cell for causing dissociation of the precursor ion by making the precursor ion collide with collision induced dissociation gas; a rear quadrupole for selecting an ion having a specific mass-to-charge ratio from various product ions produced by the dissociation; and a detector for detecting the ion passing through the rear quadrupole, and the program configured to make a computer function as:

a) a calibration information storage section for storing mass calibration information showing a relationship between the mass-to-charge ratio and a calibration value with a pressure of a collision induced dissociation gas in a case of performing a mass scan of the front quadrupole as a parameter and mass calibration information showing the relationship between the mass-to-charge ratio and the calibration value with the pressure of the collision induced dissociation gas in a case of performing a mass scan of the rear quadrupole as a parameter in an MS/MS analysis including a dissociating operation using the collision cell; and b) a controller for calibrating the mass-to-charge ratio of the ion to be detected by the detector, by selecting, according to a measurement mode of an MS/MS analysis to be performed, a necessary combination from among the mass calibration information stored in the calibration information storage section, by reading the mass calibration information corresponding to a specified pressure of the collision induced dissociation gas and by driving each of the front quadrupole and the rear quadrupole using that information.

13. The non-transitory computer-readable medium recording a program for a triple quadrupole mass spectrometer according to claim 12, wherein the calibration information storage section holds, as the aforementioned mass calibration information, mass calibration information showing the relationship between the mass-to-charge ratio and the calibration value with a mass-scan speed as a parameter in addition to the pressure of the collision induced dissociation gas.

14. The non-transitory computer-readable medium recording a program for a triple quadrupole mass spectrometer according to claim 12, wherein:

the calibration value includes a calibration value for adjusting the mass-resolving power in addition to the calibration value of the mass-to-charge ratio; and the controller performs an adjustment of the mass-resolving power concurrently with the calibration of the mass-to-charge ratio of the ion to be detected by the detector.

15. A non-transitory computer-readable medium recording a program for a triple quadrupole mass spectrometer, the program provided for use in a triple quadrupole mass spectrometer having: an ion source for ionizing a sample; a front quadrupole for selecting, as a precursor ion, an ion having a specific mass-to-charge ratio from various ions produced by the ion source; a collision cell for causing dissociation of the precursor ion by making the precursor ion collide with collision induced dissociation gas; a rear quadrupole for selecting an ion having a specific mass-to-charge ratio from various product ions produced by the dissociation; and a detector for detecting the ion passing through the rear quadrupole, and the program configured to make a computer function as:

a) a calibration information storage section for storing mass calibration information showing a relationship between the mass-to-charge ratio and a calibration value, obtained by performing an analysis including the dissociation of the precursor ion in the collision cell for a standard sample having a known mass-to-charge ratio under a collision induced dissociation gas pressure specified by a user; and b) a controller for calibrating the mass-to-charge ratio of the ion to be detected by the detector, by reading the mass calibration information from the calibration information storage section and by driving each of the front quadrupole and the rear quadrupole using that information, when an MS/MS analysis of a target sample is performed using the aforementioned collision induced dissociation gas pressure.

16. The non-transitory computer-readable medium recording a program for a triple quadrupole mass spectrometer according to claim 15, wherein:

the calibration value includes a calibration value for adjusting the mass-resolving power in addition to the calibration value of the mass-to-charge ratio; and the controller performs an adjustment of the mass-resolving power concurrently with the calibration of the mass-to-charge ratio of the ion to be detected by the detector.

* * * * *